US006409035B1

(12) United States Patent
Darr et al.

(10) Patent No.: US 6,409,035 B1
(45) Date of Patent: Jun. 25, 2002

(54) HOLLOW PLASTIC BOTTLES

(75) Inventors: Richard C. Darr, Medina; Marc A. Pedmo, Litchfield; James C. Dorn, Norton, all of OH (US)

(73) Assignee: Plastipak Packaging, Inc., Plymouth, MI (US)

( * ) Notice: Subject to any disclaimer, the term of this patent is extended or adjusted under 35 U.S.C. 154(b) by 0 days.

(21) Appl. No.: 09/770,904

(22) Filed: Jan. 26, 2001

Related U.S. Application Data

(63) Continuation-in-part of application No. 09/724,030, filed on Nov. 28, 2000.

(51) Int. Cl.[7] ..... B65D 90/02
(52) U.S. Cl. ..... 215/373; 220/600
(58) Field of Search ..... 215/373, 370–378; 220/600, 604–609, 623, 633, 634, 520

(56) References Cited

U.S. PATENT DOCUMENTS

| | | | | |
|---|---|---|---|---|
| 4,134,510 A | | 1/1979 | Chang | |
| 4,249,666 A | | 2/1981 | Hubert et al. | |
| 4,892,205 A | | 1/1990 | Powers et al. | |
| 4,993,566 A | | 2/1991 | Eberle | |
| 4,997,692 A | | 3/1991 | Yoshino | |
| 5,005,716 A | * | 4/1991 | Eberle | 215/1 C |
| 5,064,081 A | | 11/1991 | Hayashi et al. | |
| D355,124 S | * | 2/1995 | Ricci | D9/503 |
| 5,443,766 A | | 8/1995 | Slat et al. | |
| 5,464,106 A | | 11/1995 | Slat et al. | |
| 5,615,790 A | | 4/1997 | Young et al. | |
| 5,763,030 A | * | 6/1998 | Matsui | 428/35.7 |
| D448,300 S | * | 9/2001 | Walters et al. | D9/520 |

FOREIGN PATENT DOCUMENTS

| | | | | |
|---|---|---|---|---|
| EP | 3-240642 | * | 3/1991 | 215/373 |

* cited by examiner

*Primary Examiner*—Lee Young
*Assistant Examiner*—Lien Ngo
(74) *Attorney, Agent, or Firm*—Bachman & LaPointe, P.C.

(57) ABSTRACT

Biaxially oriented, hollow plastic bottle of thermoplastic material having an improved base. The base includes a plurality of circumferential rings occupying substantially the entire space between the central portion of the base and the outer supporting rim of the base. In one embodiment, the rings form substantially uniform, continuous, uninterrupted, circumferential, pyramidal ridges and adjacent depressions. In a further embodiment, some of the rings are interrupted by flat areas.

8 Claims, 4 Drawing Sheets

HOLLOW PLASTIC BOTTLES

CROSS-REFERENCE TO RELATED APPLICATION

This application is a Continuation-In-Part of copending U.S. patent application Ser. No. 09/724,030 for HOLLOW PLASTIC BOTTLES, filed Nov. 28, 2000.

BACKGROUND OF THE INVENTION

The present invention relates to a hollow plastic bottle with an improved base.

Hollow plastic bottles generally include a recessed or inwardly extending or reentrant base structure. This type of base has been found to have good resistance to deformation, especially deformation caused by the effects of internal pressure.

However, it is desirable to provide a recessed base structure for hollow plastic bottles with improved strength properties. For example, increased strength properties in the recessed base will facilitate use of the container for increased heat applications, as pasteurization. Also, increased strength properties will improve impact strength, minimizing damage when the bottles are accidentally dropped. Further, improved strength properties in the base will help prevent roll-out, i.e., under pressure or heat the plastic bottles tend to roll-out or bulge at the base.

It is, therefore, a principal object of the present invention to provide a hollow plastic bottle with an improved base.

It is a further object of the present invention to provide an improved plastic bottle as aforesaid with improved strength properties in the base.

It is a still further object of the present invention to provide an improved plastic bottle as aforesaid which is easy to prepare and which is aesthetically pleasing.

Further objects and advantages of the present invention will appear hereinbelow.

SUMMARY OF THE INVENTION

It has now been found that the foregoing objects and advantages are readily obtained in accordance with the present invention.

The hollow plastic bottle of the present invention comprises: a hollow body of thermoplastic material having a generally cylindrical side wall, an upper end with a dispensing opening therein, and a lower supporting base with an inwardly extending central portion thereof, wherein said inwardly extending base includes a continuous outer supporting annular rim for supporting the bottle on a surface, a central portion, and a plurality of substantially uniform, continuous, uninterrupted, circumferential rings occupying substantially the entire space between the central portion and the outer supporting rim, said rings forming substantially continuous, uninterrupted, uniform circumferential, pyramidal ridges and adjacent depressions. The plastic bottle is desirably biaxially oriented and blow molded, and polyethylene terephthalate is a preferred material.

In a preferred embodiment, the hollow plastic bottle of the present invention comprises: a hollow body of thermoplastic material having a generally cylindrical side wall, an upper end with a dispensing opening therein, and a lower supporting base with an inwardly extending central portion having an outside surface thereof; wherein said outside surface of said inwardly extending base includes a continuous outer supporting annular rim for supporting the bottle on a surface; a central portion of said base; wherein the space between the central portion of the base and the outer supporting rim includes a plurality of substantially uniform, continuous, uninterrupted, circumferential rings forming substantially uniform, continuous, uninterrupted, circumferential, pyramidal ridges and adjacent depressions.

Desirably, the space between the central portion of the base and the outer supporting rim includes a plurality of additional substantially uniform, circumferential rings forming circumferential, pyramidal ridges and adjacent depressions, said additional rings having at least one substantially flat area thereon. The flat areas may be one, two or three or more separate flat areas and desirably include one of designations, symbols, at least one number, and at least one letter embossed thereon. The flat areas generally interrupt said additional rings. In the preferred embodiment, the flat areas contact at least three of said additional rings.

The uninterrupted rings and additional rings preferably occupy substantially the entire space between the central portion of the base and the outer rim. In a preferred embodiment, at least two of said uninterrupted rings are provided adjacent the central portion of the base and at least two of said uninterrupted rings are provided adjacent the annular rim, with said additional rings therebetween.

The plastic bottle of the present invention has improved strength properties so that the container may be effectively utilized for increased heat applications, as for example, pasteurization, without adverse effects. In addition, the container of the present invention is less susceptible to roll-out or bulging at the base, and has improved impact properties.

Further features and advantages of the present invention will appear hereinbelow.

BRIEF DESCRIPTION OF THE DRAWINGS

The present invention will be more readily understandable from a consideration of the accompanying, illustrative drawings, wherein.

DETAILED DESCRIPTION OF PREFERRED EMBODIMENTS

Figure 2:
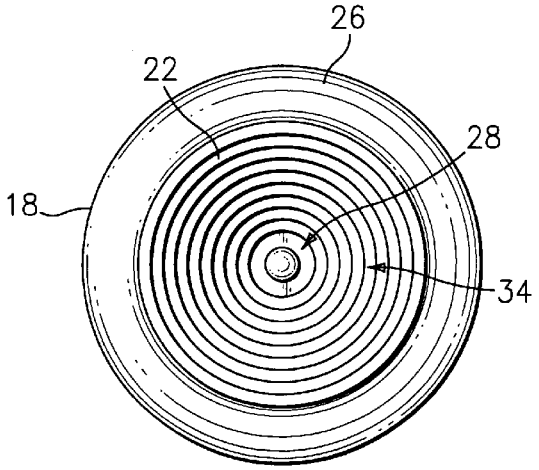
FIG. 2 is a bottom view of the base of the bottle of FIG. 1.
Figure 1:
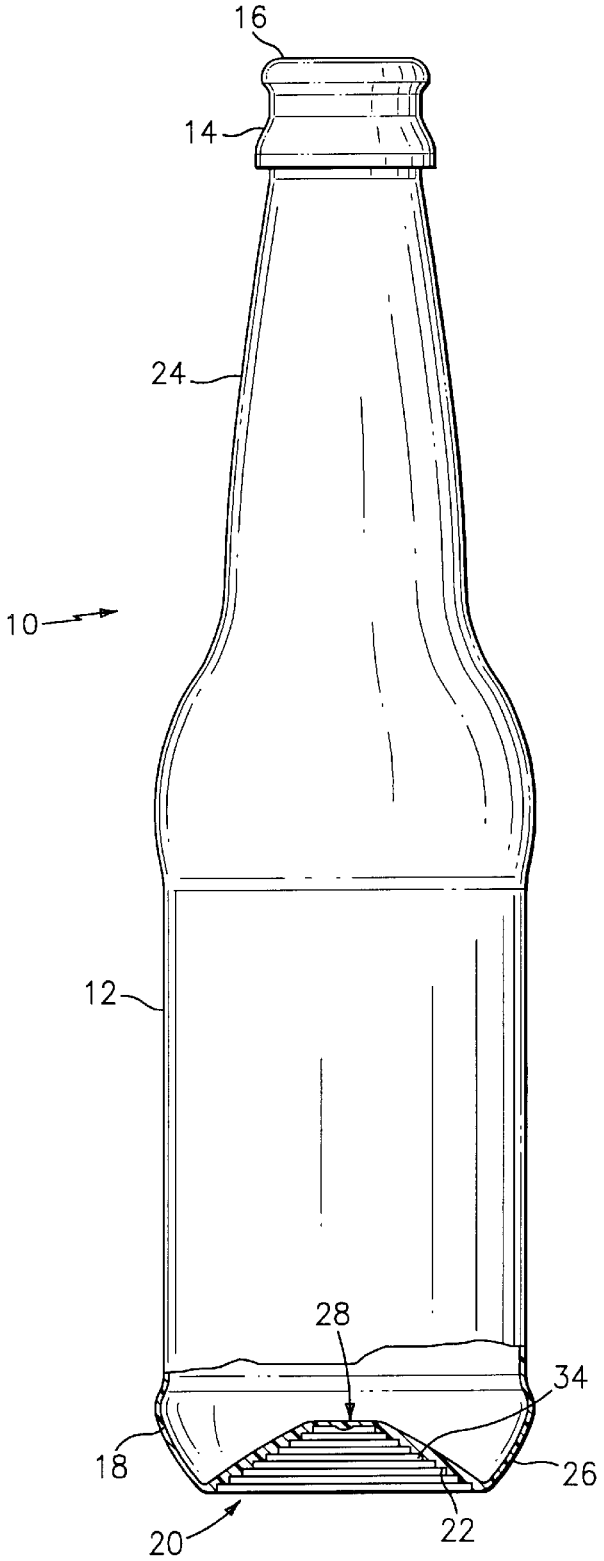
FIG. 1 is a side view of the bottle of the present invention with the base shown in section.
Figure 4:
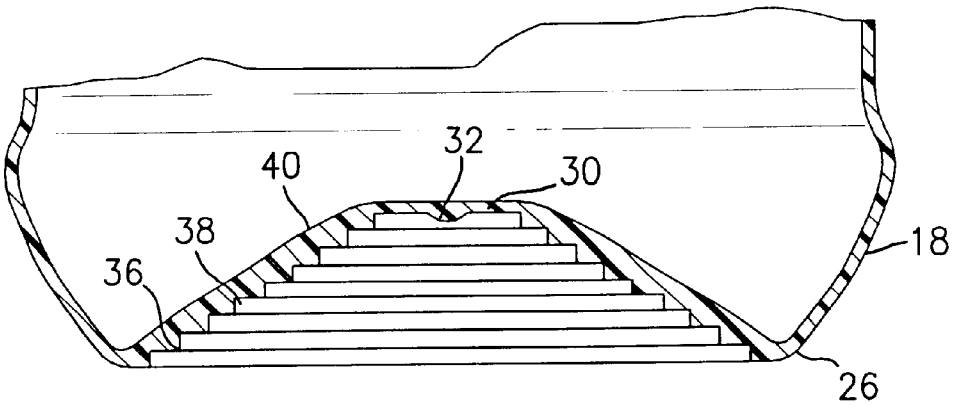
FIG. 4 is an enlarged sectional view of the base of the bottle of FIG. 1.
Figure 5:
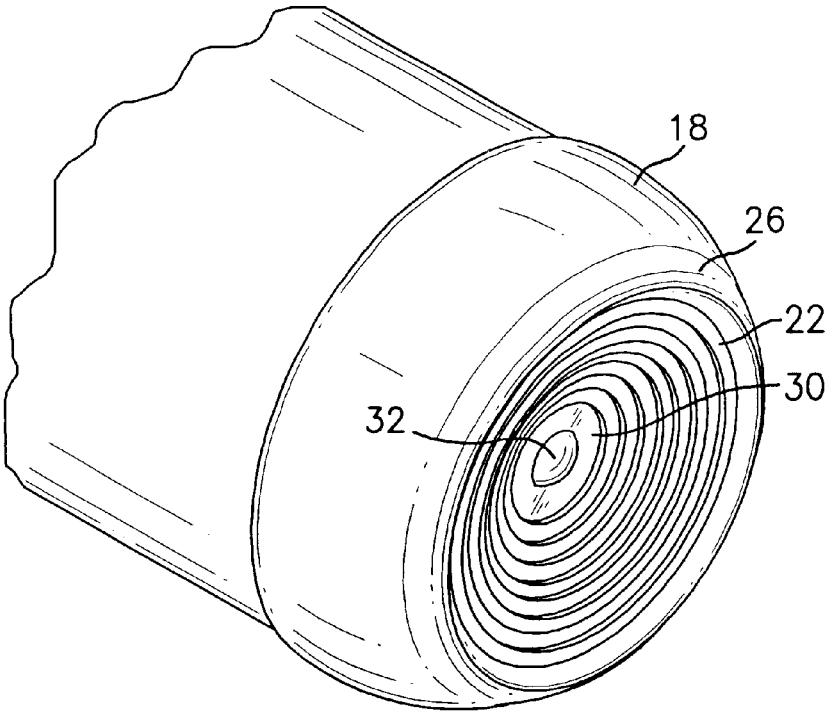
FIG. 5 is an enlarged, perspective view of the base of the bottle of FIG. 1.

Referring specifically to FIG. 1 which shows hollow plastic bottle 10 of the present, invention, said bottle includes a generally cylindrical side wall 12, an upper end 14 with a dispensing opening 16 therein which is desirably configured to hold a suitable closure (not shown), and a lower supporting base 18 which is shown in section in FIG. 1. The supporting base 18 includes an inwardly extending portion 20 having an outside surface 22 thereof shown in more detail in FIGS. 4 and 5 and which will be discussed in more detail hereinbelow.

The particular size, shape and configuration of the bottle is not especially critical and any suitable and desirable bottle configuration may be used. Thus, the configuration shown in the drawings herein represents a preferred embodiment, but others may readily be used. For example, the bottle 10 of FIG. 1 includes a neck portion 24 of reduced diameter with respect to the side wall between the cylindrical side wall 12 and upper end 14, but the side wall may if desired extend directly to the upper end with only a short, inwardly extending transition portion as is common in for example two liter plastic bottles. Naturally, other suitable configurations may readily be employed, as one or two liter bottles, 16 ounce bottles, 8 ounce bottles, etc.

The outside surface 22 of the inwardly extending portion 20 includes a continuous, outer supporting annular rim 26 for supporting the bottle 10 on a surface. In addition, the lower supporting base includes a central portion or hub 28 with a substantially flat annular portion 30 thereof, and a downwardly extending central, button-like portion 32 thereof, see particularly FIGS. 4 and 5. Still further, the outside surface 22 of the inwardly extending portion 20 includes a plurality of substantially uniform, continuous, uninterrupted, circumferential rings 34 occupying substantially the entire space between the central portion 28 of the base 18 and the outer supporting rim 26. Rings 34 form substantially uniform, continuous, uninterrupted circumferential, pyramidal ridges 36 and adjacent depressions 38 and form a step-like configuration between the outer rim 26 and central portion 28 as clearly shown in FIG. 4. Also, the inside surface 40 of the inwardly extending portion 20 of base 18 desirably includes a substantially smooth inside surface opposed to outside surface 22, also as clearly shown in FIG. 4.

The base construction of the present invention as shown in the drawings and described above has been found to be quite advantageous. Thus, this provides considerable increased strength in a critical location. For example, the bottle of the present invention may be effectively used for increased heat applications, is less susceptible to roll-out or bulging at the base, and generally has improved impact properties. Also, the construction is simply and easily prepared and results in an aesthetically pleasing configuration.

A plurality of these rings are provided forming a continuous, step-like configuration. Generally, at least five rings are provided, and preferably from 5 to 10, but the exact number will depend on container size and the specific application.

Figure 3:
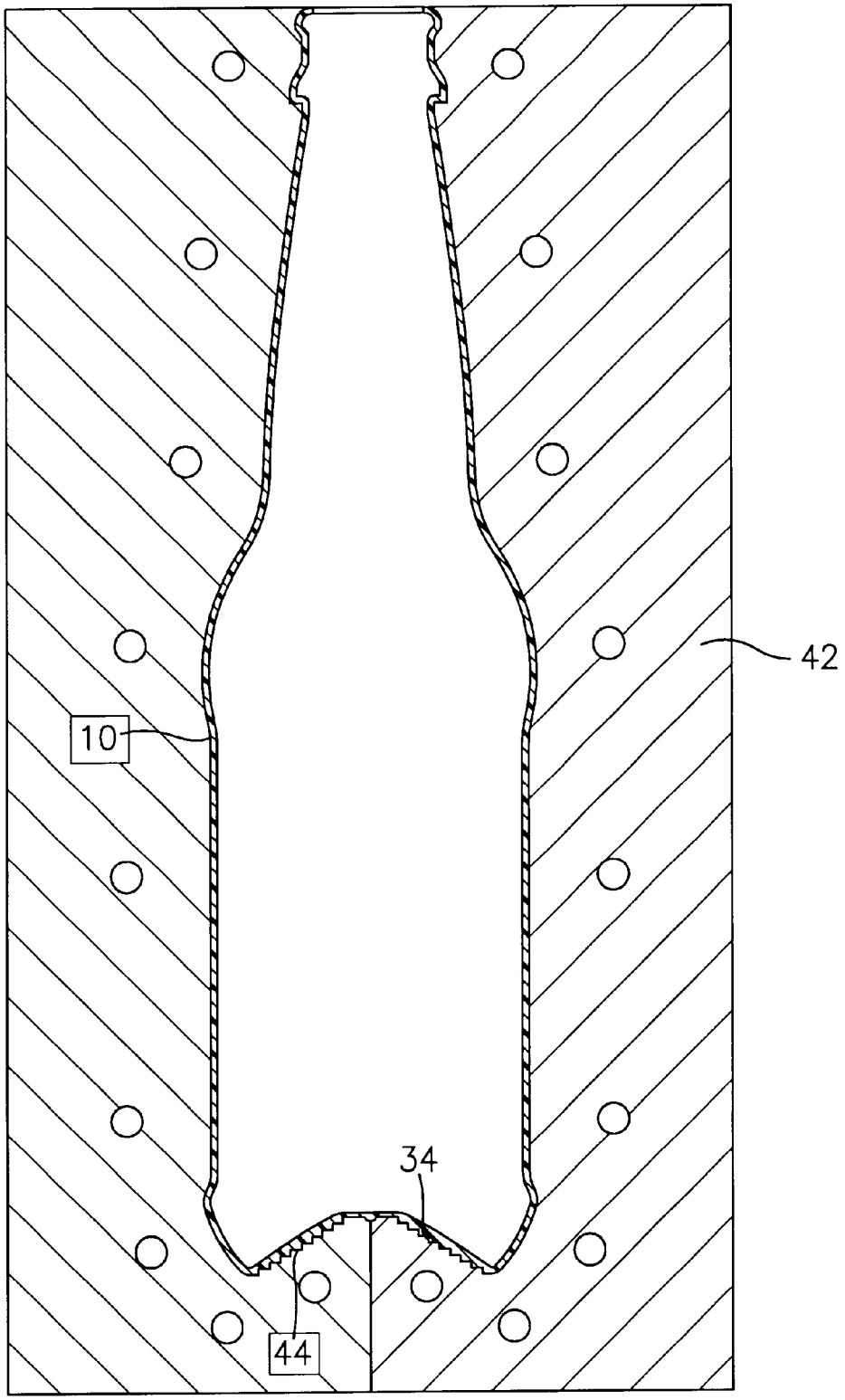
FIG. 3 is a sectional view of a blow mold with the final blow molded bottle of FIG. 1 therein.

The container or bottle of the present invention is desirably blow molded and biaxially oriented by injection stretch blow molding, in a blow mold 42 as shown in FIG. 3 in a conventional manner from an injection molded or compression molded preform with the rings 34 formed from corresponding rings 44 in the blow mold. However, the bottle may readily be prepared by simply injection molding.

Preferably, the plastic is polyethylene terephthalate; however, other suitable plastics may be readily used alone or in combination or in a multilayered configuration. For example, polyolefins, polyethylene naphthalate, polyvinyl chloride, and others.

Figure 6:
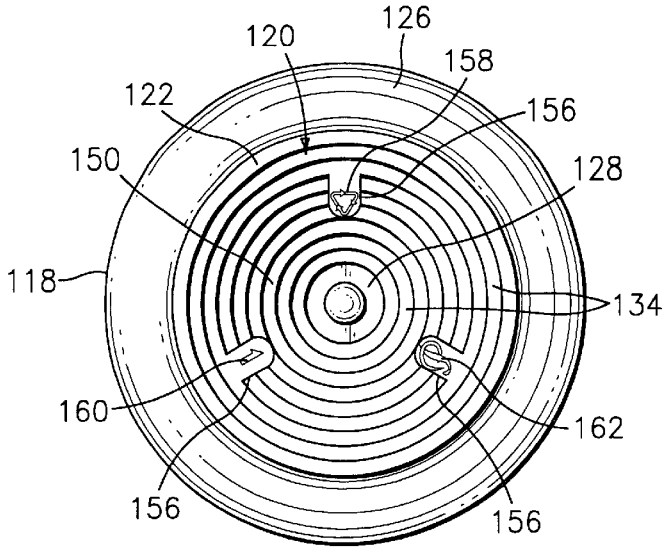
FIG. 6 is a bottom view of an alternate embodiment of the bottle of the present invention.
Figure 7:
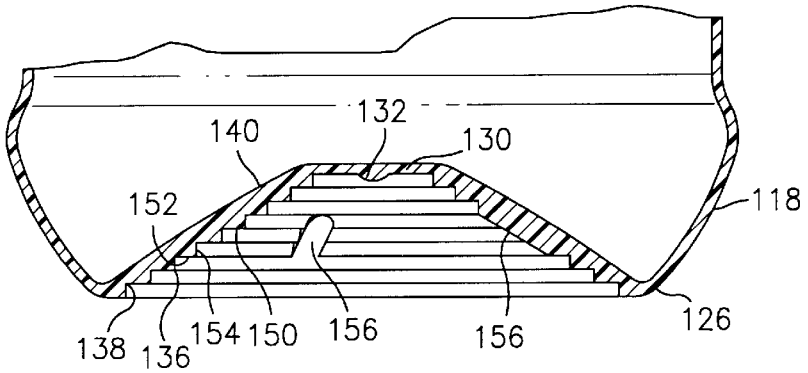
FIG. 7 is an enlarged sectional view of the base of the bottle of FIG. 6.
Figure 8:
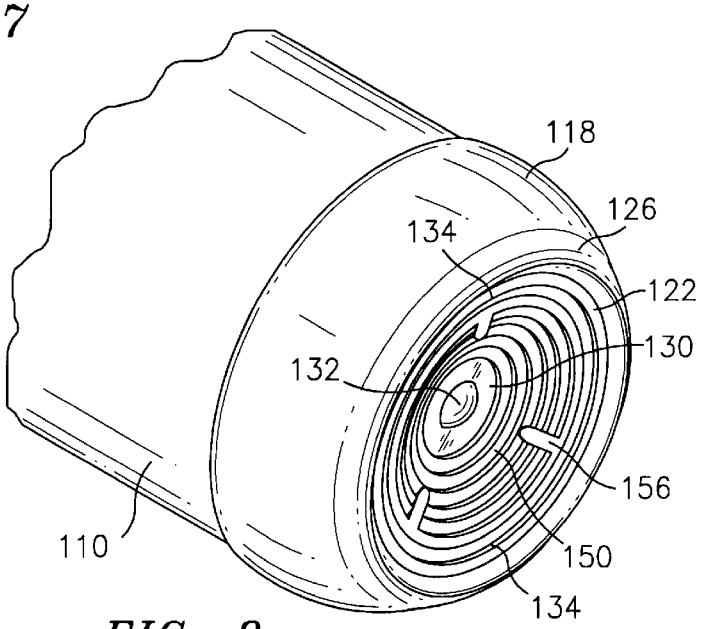
FIG. 8 is an enlarged perspective view of the base of the bottle of FIG. 6.

FIGS. 6–8 show an embodiment of the present invention wherein the base of the bottle includes at least one substantially flat area thereon. In the embodiment of FIGS. 6–8, the bottle may if desired have the same configuration as hollow plastic bottle 10 shown in FIG. 1, including a generally cylindrical side wall 12, an upper end 14 with a dispensing opening 16 therein which is desirably configured to hold a suitable closure and a lower supporting base 118, the features of which are clearly shown in FIGS. 6–8. As with the embodiment of FIGS. 1–5, the particular size, shape and configuration of the bottle is not especially critical and any suitable and desirable bottle configuration may readily be used.

Referring specifically to FIGS. 6–8, the outside surface 122 of the inwardly extending portion 120 includes a continuous, outer supporting annular rim 126 for supporting the bottle 110 on a surface. In addition, the lower supporting base includes a central portion or hub 128 with a substantially flat annular portion 130 thereof, and a downwardly extending central, button-like portion 132 thereof as clearly shown in FIGS. 7 and 8 and as also characterizing the embodiment of FIGS. 1–5.

The outside surface 122 of the inwardly extending portion 120 includes a plurality of substantially uniform, continuous, uninterrupted, circumferential rings 134 in the space between the central portion 128 of base 118 and the outer supporting rim 126. Specifically, at least two of the uninterrupted rings 134 are provided adjacent central portion 128 and at least two of the uninterrupted rings 134 are provided adjacent annular rim 126. The exact number of uninterrupted rings 134 is not especially critical and will depend on factors such as bottle dimensions and size, number and placement of the substantially flat areas, as will be discussed hereinbelow. The uninterrupted rings 134 form substantially uniform, continuous, uninterrupted, circumferential, pyramidal ridges 136 and adjacent depressions 138 and form a step-like configuration between outer rim 126 and central portion 128 as clearly shown in FIG. 7. Also, the inside surface 140 of the inwardly extending portion 120 of base 118 desirably includes a substantially smooth inside surface opposed to outside surface 122, also as clearly shown in the drawings.

In addition to the uninterrupted rings 134, the outside surface 122 of the inwardly extending portion 120 includes a plurality of additional, substantially uniform circumferential rings 150 forming pyramidal ridges 152 and adjacent depressions 154. The additional rings 150 are interrupted by at least one substantially flat area 156, with three (3) separate flat areas or pads 156 shown in the embodiment of FIGS. 6–8, preferably uniformly spaced around the additional rings as shown. Although three (3) of the flat areas is preferred, the exact number is not especially critical and will depend for example on bottle size and particularly desired results. Also, as shown in FIGS. 6–8, the flat areas preferably contact and interrupt at least three of the additional rings 150. The uninterrupted rings 134 plus the additional rings 150 occupy substantially the entire space between the central portion 128 and outer rim 126.

The flat portions desirably include information thereon. For example, one can include the recycle symbol 158, one can include a number 160 which can show mold number, lot number or desired identification, and one can include a corporate logo designation or letter designation 162.

In addition to the advantages of the embodiment of FIGS. 1–5, the embodiment of FIGS. 6–8 provide the additional advantages of adding a flex point to relieve internal stress and to aid in preventing roll out, while at the same time providing convenient site for embossing useful information thereon in an unobtrusive manner.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A hollow plastic bottle, which comprises:

a hollow body of thermoplastic material having a generally cylindrical side wall, an upper end with a dispensing opening therein, and a lower supporting base with an inwardly extending portion having an outside surface thereof;

wherein said outside surface of said inwardly extending base includes a continuous outer supporting annular rim for supporting the bottle on a surface;

a central portion of the inwardly extending portion of said base; and wherein the space between the central portion of the base and the outer supporting rim includes a plurality of substantially uniform, continuous, uninterrupted, circumferential rings forming substantially uniform, continuous, uninterrupted, circumferential, pyramidal ridges and adjacent depressions, wherein said space also includes a plurality of additional substantially uniform, circumferential rings forming pyramidal ridges and adjacent depressions, said additional rings having at least one substantially flat area thereon.

2. A hollow plastic bottle according to claim 1, including three separate flat areas.

3. A hollow plastic according to claim 1, wherein said flat areas contact at least three of said additional rings.

4. A hollow plastic bottle according to claim 1, wherein said uninterrupted rings and additional rings occupy substantially the entire space between the central portion of the base and the outer rim.

5. A hollow plastic bottle according to claim 4, including at least two of said uninterrupted rings adjacent the central portion of the base and at least two of said uninterrupted rings adjacent the annular rim, with said additional rings therebetween.

6. A hollow plastic bottle according to claim 1, wherein said flat areas separately include one of symbols, at least one number, and at least one letter, embossed thereon.

7. A hollow plastic bottle according to claim 1, wherein said flat areas interrupt said additional rings.

8. A hollow plastic bottle according to claim 2, wherein said flat areas are substantially uniformly spaced around said additional rings.

* * * * *